US006862749B1

(12) United States Patent
Krause

(10) Patent No.: US 6,862,749 B1
(45) Date of Patent: Mar. 8, 2005

(54) HELMET NECK SKIRT SYSTEM

(76) Inventor: Richard Krause, 4012 Chelsey Ave., Baltimore, MD (US) 21206

( * ) Notice: Subject to any disclaimer, the term of this patent is extended or adjusted under 35 U.S.C. 154(b) by 0 days.

(21) Appl. No.: 10/782,121

(22) Filed: Feb. 19, 2004

(51) Int. Cl.[7] ..... A42B 1/24
(52) U.S. Cl. ..... 2/422; 2/424; 2/468; 2/909
(58) Field of Search ..... 2/424, 422, 205, 2/909, 468

(56) References Cited

U.S. PATENT DOCUMENTS 2,105,028 A * 1/1938 Dickhoff ..... 2/421
3,825,952 A * 7/1974 Pershing et al. ..... 2/422
4,017,906 A * 4/1977 Bochynsky et al. ..... 2/10
4,042,976 A * 8/1977 Reynolds ..... 2/135
4,215,437 A * 8/1980 Kao ..... 2/424
4,638,510 A 1/1987 Hubbard
4,697,289 A * 10/1987 Luigi ..... 2/422
5,095,550 A 3/1992 Perlinger
5,329,641 A 7/1994 Kalhous
5,915,537 A * 6/1999 Dallas et al. ..... 2/410
6,009,563 A * 1/2000 Swanson et al. ..... 2/425
6,295,652 B1 * 10/2001 Mazur ..... 2/422

* cited by examiner

*Primary Examiner*—Rodney M. Lindsey

(57) ABSTRACT

A helmet neck skirt system for covering an entirety of a user's neck to inhibit debris and adverse weather from providing discomfort to the user includes a collar member couplable to a full circumferential length around a base portion of a protective helmet such that the collar member extends down from the helmet generally parallel to the user's neck. Thus, the collar remains in generally spaced relationship to the user's neck and permits the insertion of an upper portion of a jacket or shirt worn by the user between the neck of the user and the lower portion of the collar. The collar extends down a distance sufficient to cover an entirety of the user's neck.

10 Claims, 2 Drawing Sheets

HELMET NECK SKIRT SYSTEM

BACKGROUND OF THE INVENTION

1. Field of the Invention

The present invention relates to helmets and more particularly pertains to a new helmet-neck skirt system for covering an entirety of a user's neck to inhibit debris and adverse weather from providing discomfort to the user.

2. Description of the Prior Art

The use of helmets is known in the prior art. U.S. Pat. No. 5,095,550 issued to Perlinger on Mar. 17, 1992 describes a helmet closure extending from spaced attachment points on a helmet downwardly and generally inwardly to cover and enclose a top of a user's neck in a snug fashion. Another type of helmet and neck extension is U.S. Pat. No. 4,638,510 issued to Hubbard on Jan. 27, 1987 having a protective helmet and stiff neck member extending outwardly to abut surrounding structure to restrict head movement in the event of an accident in a high performance vehicle. U.S. Pat. No. 5,329,641 issued to Kalhous on Jul. 19, 1994 discloses a generally U-shaped stiff neck protector pivotally connected at two points and hanging down from a front edge of a helmet.

While these devices fulfill their respective, particular objectives and requirements, the need remains for a neck skirt that provides more thorough coverage of a user's neck while minimizing restriction on neck movement and minimizing tight engagement of the throat of the user to enhance comfort.

SUMMARY OF THE INVENTION

The present invention generally comprises a collar member couplable to a full circumferential length around a base portion of a protective helmet such that the collar member extends down from the helmet generally parallel to the user's neck. Thus, the collar remains in generally spaced relationship to the user's neck and permits the insertion of an upper portion of a jacket or shirt worn by the user between the neck of the user and the lower portion of the collar. The collar extends down a distance sufficient to cover an entirety of the user's neck.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
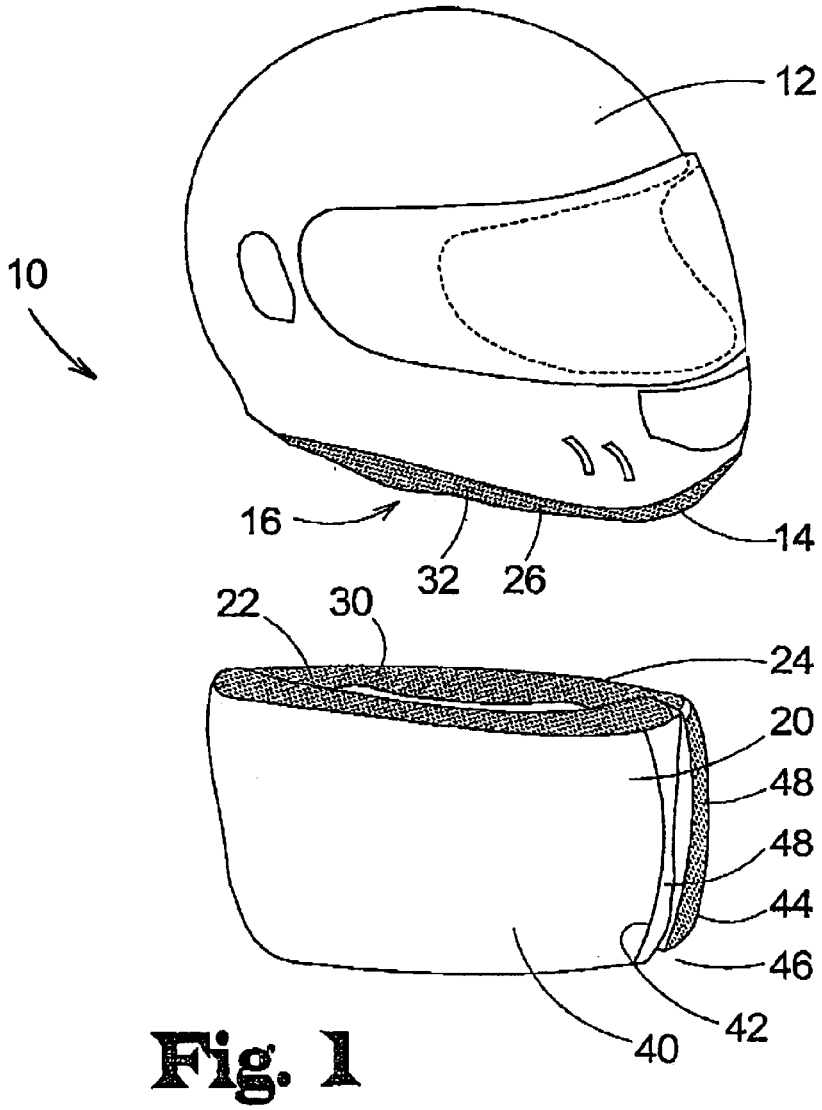
FIG. 1 is a perspective exploded in-use view of a new helmet neck skirt system according to the present invention.
Figure 2:
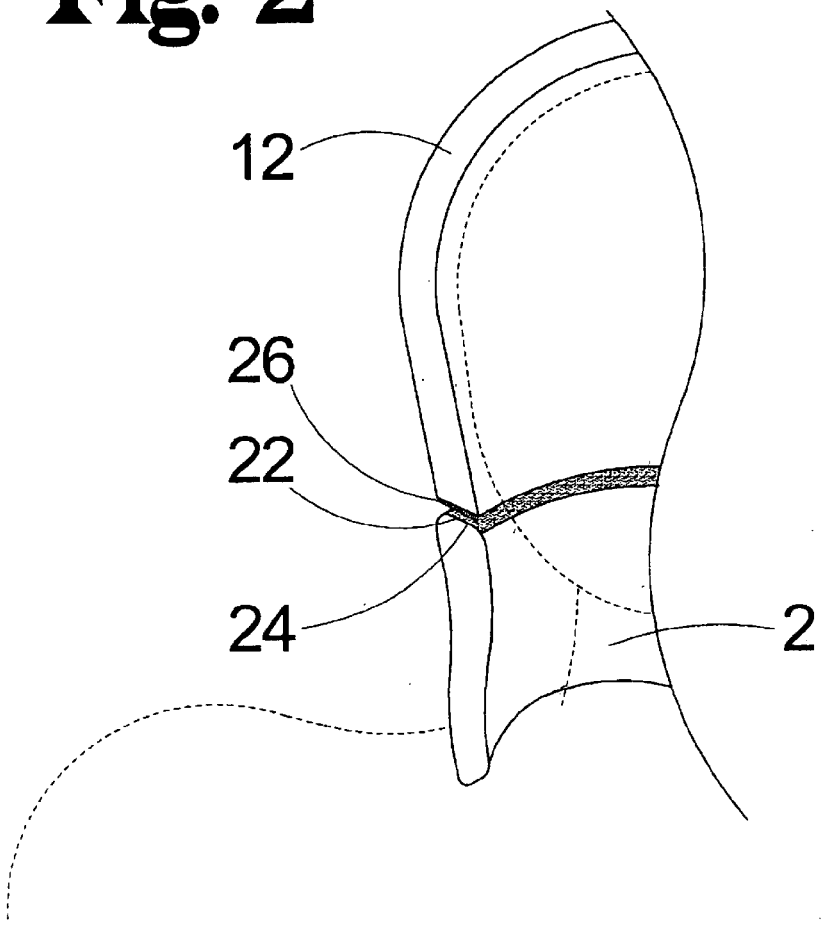
FIG. 2 is a cross-sectional view of the present invention in use.

With reference now to the drawings, and in particular to FIGS. 1 and 2 thereof, a new helmet neck skirt system embodying the principles and concepts of the present invention and generally designated by the reference numeral 10 will be described.

As best illustrated in FIGS. 1 and 2, the helmet neck skirt system 10 generally comprises a helmet 12 having a base portion 14 extending around a lower opening 16 into the helmet 12. A collar member 20 is couplable to the helmet 12 such that the collar member 20 extends down from the base portion 14 of the helmet 12. The collar member 20 when in place has a substantially consistent circumference such that the collar member 20 is designed for extending from the helmet 12 in spaced relationship to a neck 2 of a user wearing the helmet 12. Thus, the collar does not provide a restrictive or uncomfortable feel against the neck of the user.

Preferably, the collar member 20 is constructed of leather or a similar material. The collar member may be lined for comfort or to provide additional stiffness if desired. The leather is typically semi-stiff to resist deformation and touching of the user's neck due to wind force, insects, or other small road debris that may be likely to impact the collar member as a user rides a motorcycle, ATV or similar vehicle. The collar member is however, generally flexible enough to permit full movement of the user's neck such that the collar member does not inhibit the range of motion of the user's neck.

In an embodiment, a first fastening member 22 is coupled to the collar member 20 along a top edge 24 of the collar member 20. A complimentary second fastening member 26 is coupled to the helmet 12 for fastening the top edge 24 of the collar member 20 to the helmet 12. Preferably, the first fastening member 22 is a portion of hook and loop fastener 30 and the second fastening member 26 is a complimentary portion of hook and loop fastener 32. The second fastening member 26 is typically coupled to the base portion 14 of the helmet 12 although alternative arrangements may be employed in which the collar attaches to the helmet in another area.

It is preferred that the first portion of hook and loop fastener 30 extends a full length along the top edge 24 of the collar member 20 and the second portion of hook and loop fastener 32 extends along a full length of the base portion 14 of the helmet 12 to provide a continuous connection around the entirety of the base portion 14.

The collar member 20 is preferably an elongated piece of material 40 having opposite ends 42, 44. The opposite ends 42, 44 are couplable together to form the collar member 20 into an annular shape positionable around the neck 2 of the user. A closure means 46 for coupling the opposite ends 42, 44 of the collar member 20 is provided. Preferably, the closure means 46 comprises complimentary portions of hook and loop fastener 48 coupled to the opposite ends 42, 44 of the collar member 20. This provides for some adjustment of the collar member to allow some variation in circumference along the length of the collar member for additional comfort or to accommodate positioning of clothing or the like between the collar member and the neck of the user.

In use, the collar member is attached to the helmet before or after the user puts on the helmet. The collar is secured to the helmet such that the collar extends loosely down around the neck of the user and substantially covers an entirety of the neck of the user. The collar member is positioned over any clothing that may be on the neck of the user and typically extends down fully to a point touching the shoulders (or clothing covering the shoulders) of the user. Inherent stiffness in the collar member and attachment to the helmet along a full length of the base portion of the helmet protects the neck of the user from debris, precipitation, and wind.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A helmet neck skirt system comprising:

a helmet having a base portion extending around a lower opening into said helmet;

a collar member couplable to said helmet such that said collar member extends down from said base portion of said helmet;

wherein said collar member has a substantially consistent circumference such that said collar member is adapted for extending from said helmet in spaced relationship to a neck of a user wearing said helmet;

a first fastening member coupled to said collar member along a top edge of said collar member such that said top edge of said collar member extends between an interior face and an exterior face of said collar member; and a complimentary second fastening member coupled to said helmet for fastening said top edge of said collar member to said helmet such that said collar member is substantially aligned with said base portion of said helmet to permit liquid on the outside of said helmet to flow onto said collar member.

2. The helmet neck skirt system of claim 1 wherein said collar member is constructed of leather.

3. The helmet neck skirt system of claim 1 wherein said first fastening member is a portion of hook and loop fastener and said second fastening member is a complimentary portion of hook and loop fastener.

4. The helmet neck skirt system of claim 3 wherein said first portion of hook and loop fastener extends a full length along a top edge of said collar member and said second portion of hook and loop fastener extends along a full length of said base portion of said helmet.

5. The helmet neck skirt system of claim 1 wherein said second fastening member is coupled to said base portion of said helmet.

6. The helmet neck skirt system of claim 1, further comprising:

said collar member being an elongated material having opposite ends, said opposite ends being couplable together to form said collar member into an annular shape positionable around the neck of the user.

7. The helmet neck skirt system of claim 6, further comprising:

a closure means for coupling said opposite ends of said collar member.

8. The helmet neck skirt system of claim 7 wherein said closure means is complimentary portions of book and loop fastener coupled to said opposite ends of said collar member.

9. A helmet neck skirt system comprising:

a helmet having a base portion extending around a lower opening into said helmet;

a collar member couplable to said helmet such that said collar member extends down from said base portion of said helmet;

wherein said collar member has a substantially consistent circumference such that said collar member is adapted for extending from said helmet in spaced relationship to a neck of a user wearing said helmet;

a first fastening member coupled to said collar member along a top edge of said collar member such that said top edge of said collar member extends between an interior face and an exterior face of said collar member;

a complimentary second fastening member coupled to said helmet for fastening said top edge of said collar member to said helmet such that said collar member is substantially aligned with said base portion of said helmet to permit liquid on the outside of said helmet to flow onto said collar member;

wherein said first fastening member is a portion of hook and loop fastener and said second fastening member is a complimentary portion of hook and loop fastener;

wherein said second fastening member is coupled to said base portion of said helmet;

wherein said first portion of hook and loop fastener extends a full length along a top edge of said collar member and said second portion of book and loop fastener extends along a full length of said base portion of said helmet;

said collar member being an elongated material having opposite ends, said opposite ends being couplable together to form said collar member into an annular shape positionable around the neck of the user;

a closure means for coupling said opposite ends of said collar member; and wherein said closure means is complimentary portions of hook and loop fastener coupled to said opposite ends of said collar member.

10. The helmet neck skirt system of claim 9 wherein said collar member is constructed of leather.

* * * * *